United States Patent [19]

King et al.

[11] Patent Number: 4,758,300

[45] Date of Patent: Jul. 19, 1988

[54] HIGH SPEED LABELLING MACHINE

[75] Inventors: George King, Stouffville; Geoffrey A. Fox, Scarborough, both of Canada

[73] Assignee: Stackpole Limited, Scarborough, Canada

[21] Appl. No.: 8,582

[22] Filed: Jan. 29, 1987

[30] Foreign Application Priority Data

Oct. 3, 1986 [CA] Canada ..... 519749

[51] Int. Cl.[4] ..... B65C 9/04; B65C 9/18

[52] U.S. Cl. ..... 156/357; 118/231; 118/681; 156/458; 156/497; 156/568; 156/571; 156/578; 156/DIG. 26; 156/DIG. 33

[58] Field of Search ..... 156/357, 364, 450, 458, 156/521, 568, 571, 578, DIG. 33, DIG. 26, 497, DIG. 44; 118/231, 681

[56] References Cited

U.S. PATENT DOCUMENTS

| | | | |
|---|---|---|---|
| 2,703,660 | 3/1955 | Von Hofe et al. | 156/571 |
| 3,005,565 | 10/1961 | Doane et al. | 156/571 |
| 3,586,580 | 6/1971 | Dullinger | 156/458 |
| 3,598,675 | 8/1971 | Bofinger et al. | 156/450 |
| 3,963,557 | 6/1976 | Patterson | 156/568 |
| 4,242,167 | 12/1980 | Hoffmann | 156/357 |
| 4,309,237 | 1/1982 | Wemke et al. | 156/568 |
| 4,354,887 | 10/1982 | Total | 156/357 |
| 4,592,796 | 6/1986 | Schlacht | 156/450 |
| 4,629,528 | 12/1986 | Tanaka et al. | 156/DIG. 33 |
| 4,632,721 | 12/1986 | Hoffmann et al. | 156/568 |

FOREIGN PATENT DOCUMENTS

| | | | |
|---|---|---|---|
| 2015962 | 9/1979 | United Kingdom | 156/571 |

*Primary Examiner*—Michael Wityshyn

[57] ABSTRACT

Improvement in the process and the apparatus for applying strip labels are made possible by a vacuum drum having a deformable outer surface controlled to be at least essentially cylindrical during initial application of a label to an article and selectively deformable to cause portions of a label thereon to be brought into contact with a glue applying roll. The apparatus uses a component vacuum drum where selective portions of the drum are replaced and other components repositioned to effect changeover from one label length to another.

9 Claims, 7 Drawing Sheets

HIGH SPEED LABELLING MACHINE

BACKGROUND OF THE INVENTION

The present invention relates to labelling machines for applying strip labels and in particular wraparound labels. The machine is designed to cut a label from a label supply and then adhesively secure the label to an article such as a bottle.

Labelling machines using material feed from a bulk roll continue to gain market acceptance due to the low cost of the label supply as well as the excellent print characteristics that can be obtained. The labels are supplied in roll form and the strip of labels is advanced and cut to the correct label length. The label is then transferred by a vacuum drum past an adhesive station in preparation for transfer to a synchronized article to be labelled. The labels are typically made of a thin plastic film. These machines must also address the problems of applying glue to various portions of the label and/or all of the label, and normally have some capability for varying the length of label to be applied as required for different product sizes. One particular labelling machine uses a vacuum drum having outward deformations at what would be the leading and trailing edge of a label appropriately positioned thereon, such that the outward deformations force this limited portion of the label against a glue column or glue roll as it is transferred from the label supply to the article to be labelled. In the event that a label is not present on the drum, the glue roller is retracted and must be repositioned to resume the labelling cycle. In order to vary the machine for different length labels, the entire vacuum drum is replaced. It is also necessary in some application to provide a high speed labelling machine which is still capable of applying the labels with the same degree of accuracy, or at least to produce a satisfactory product. It must be noted that wrap labels represent a major portion of the appearance of the product and as such, the labelling process must be reliable.

There remains a need for a reliable, flexible apparatus having improvements with respect to the application of glue to the leading and trailing edges of a label or various portions of the label as well as simplified adjustment to effect changeover from one label length to another.

In high speed applications, further control of the spacing and vertical aligning of the article to be labelled is necessary to effect the required control to assure proper synchronization of the article to be labelled and the label. In a preferred embodiment of the invention, a pocket wheel and feed screw are combined at the infeed of the machine to provide greter precision.

SUMMARY OF THE INVENTION

In a labelling machine, according to the present invention, a vacuum drum is adapted to receive labels and transport the same to the desired location, where the vacuum drum includes a plurality of moveable pads positioned for selectively moving the leading or trailing end portion of a received label outwardly of the normal circumference of the drum a predetermined distance and in a manner to avoid shifting of at least the leading edge of the received label on the pad and drum. These pads cooperate with a control means to assure proper movement of the pads from the initial position forming part of the normal circular circumference of the drum to the displaced position for glue application.

According to another aspect of the invention, improvements in the spacing and vertical alignment of the articles to be labelled is achieved by using in combination a feed screw and pocket wheel to control the articles to be labelled immediately before, and upstream of the vacuum drum. The feed screw advantageously separates the articles to be labelled to the machine pitch with the pocket wheel assuring accurate spacing and vertical alignment between the articles as they come into contact with the vacuum drum, as well as providing the means to effect a change in direction of the articles from the longitudinal axis of the conveyor to a generally tangential position for the subsequent movement with the vacuum drum to effect label transfer.

BRIEF DESCRIPTION OF THE DRAWINGS

Preferred embodiments of the invention are shown in the drawings wherein.

DETAILED DESCRIPTION OF THE EMBODIMENTS

Figure 1:
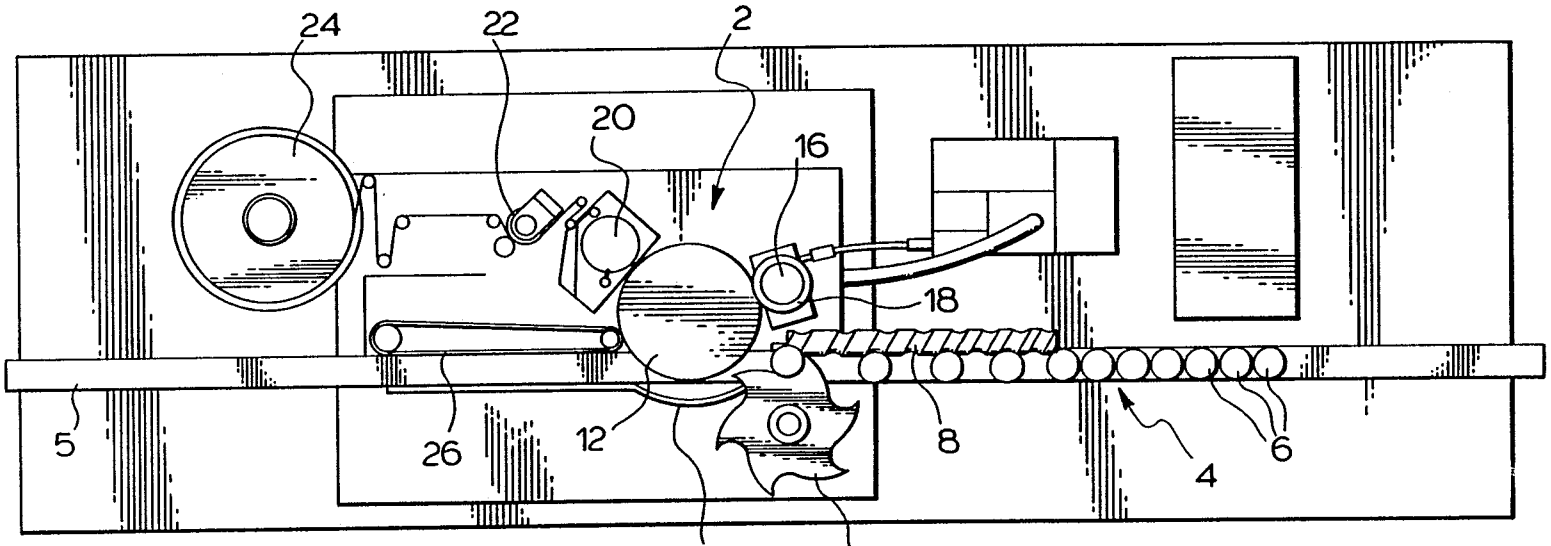
FIG. 1 is a top schematic view showing the various components of the labelling machine.

The labelling apparatus generally shown as 2 in FIG. 1 has a straight conveyor 4 for advancing articles 6 to be labelled past a labelling arrangement for eventual discharge at point 5 for further packaging thereafter. A queue of articles to be labelled generally accumulates upstream of the feed screw 8 which serves to appropriately space the articles to be labelled and synchronize the articles with a label on the vacuum drum 12. A pocket wheel 10 is also used in combination with the feed screw 8 as it has been found that this pocket wheel maintains accurate vertical alignment of the articles to be labelled as they are brought into contact with the vacuum drum 12. Furthermore, the pocket wheel has increased control on the article to be labelled as it is brought into relationship with the vacuum drum, and this control, with respect to position and direction of movement, improves the synchronization accuracy and vertical alignment of the label and the article. In some applications such as low speed labelling machines, the feed screw by itself or the pocket wheel by itself will be sufficient as each of these devices is known to provide synchronization of an article to be labelled and a label. However, it has been found the particular combination of the feed screw, which provides more gentle acceleration of the articles to be labelled, and the pocket wheel, achieves more accurate synchronization and alignment of the label and article. It can also be seen from the overview of FIG. 1 that the pocket wheel 10 serves to provide a means for imparting a transitional movement of the article to be labelled from the straight line direction of conveyor 4 to a tangential position as it contacts the vacuum drum 12 whereafter it is moved in accordance with the vacuum drum. Again, this achieves a more efficient handling of the article and preparation of the article as it is brought into contact with the vacuum drum 12.

The pocket wheel 10 is sized to engage the article at vertically spaced points which ensure the article is vertical as it is brought into contact with a label. The individual pockets of the wheel may be of a depth and shape to cooperate with the article for appropriately spaced contact therewith or the wheel may be split and separated to achieve the desired contact.

The vacuum drum 12 has labels, cut from the strip supply of labels, on the vacuum drum surface where glue is applied to various portions of the label as they are brought into contact with the glue column generally shown as 16. The vacuum drum 12 is of the type whereby the portions to be glued are displaced on the vacuum drum surface to achieve contact with the glue column 16, and a large portion of the vacuum drum remains substantially spaced from the glue column at all times. Details of this arrangement will be explained with respect to FIGS. 6 through 9.

Figure 2:
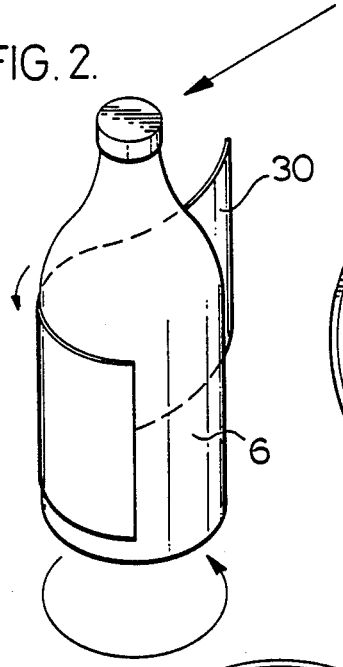
FIG. 2 shows schematically the application of a wrap label to an article to be labelled.
Figure 3:
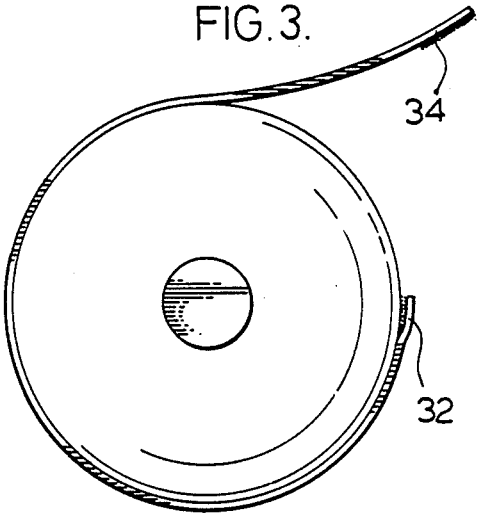
FIG. 3 is a top view of an article to be labelled and a wrap label being applied thereabout.

The vacuum drum 12 functions in combination with a curved cushion rail 14 which engages a surface of the article to be labelled and holds the same as the vacuum drum urges the article to rotate about its longitudinal axis. This achieves a wrapping of the label about the article as generally shown in FIGS. 2 and 3. Once the label has been applied to the article, it is brought into contact with a compression belt 26 which again continues the rotational movement of the article to achieve an efficient wrap of the label about the article.

The bulk label supply 24 is generally in roll form and is trained through a number of tensioning rollers, advanced through a drive arrangement generally shown as 22, and past a vacuum drum cutter generally shown as 20. The vacuum drum cutter separates the individual labels from the strip of labels and applies the labels to the vacuum drum 12.

Figure 4:
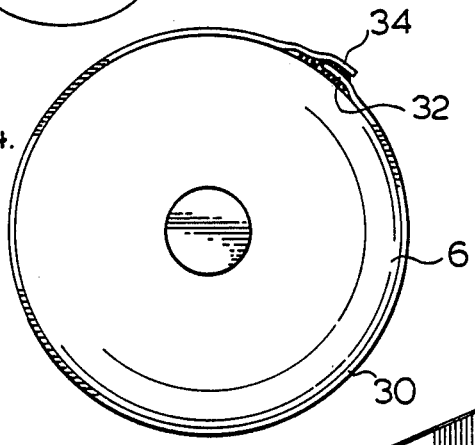
FIG. 4 shows a labelled article.
Figure 5:
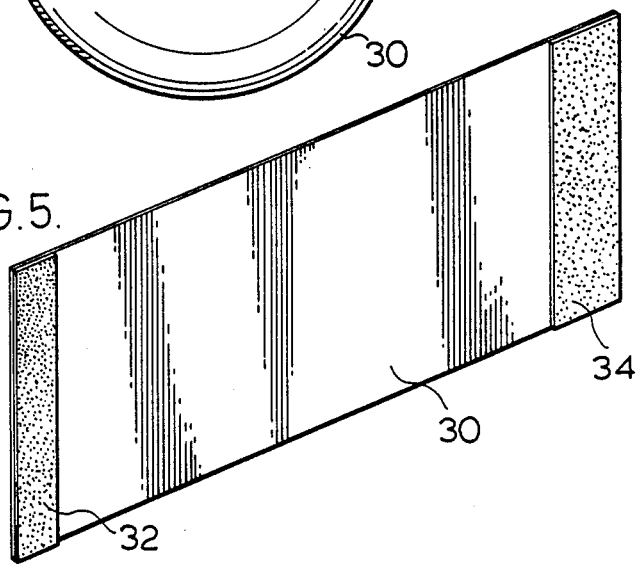
FIG. 5 shows a wrap label with glue applied to the leading and trailing edges.

The apparatus of FIG. 1 is of the type to wrap the label 30 as shown in FIG. 2 about the article 6 to achieve the full overlapped relationship generally shown in FIG. 4. In this case, glue is applied to the leading edge 32, which is brought into synchronized contact with the article 6, with the label and article then being rotated to acheive the full wraparound condition as shown in FIG. 4 where the trailing edge 34 is brought into an overlap relationship with the leading edge 32, thereby adhering the wraparound label about the article 6. The trailing edge 34 of the label has had a wider band of adhesive applied thereto such that a portion of the trailing edge is directly adhered to the article and a further portion is in an adhered overlap relationship with the leading edge 32. This machine utilizes the broad concepts of the prior art devices where a label is separated from a label supply, brought into synchronized contact with an article to be labelled by means of a vacuum drum which, in combination with a rail and other belt means, wraps the label about the article and appropriately engages the article to ensure that adhesion is achieved between the label and the article.

Figure 6:
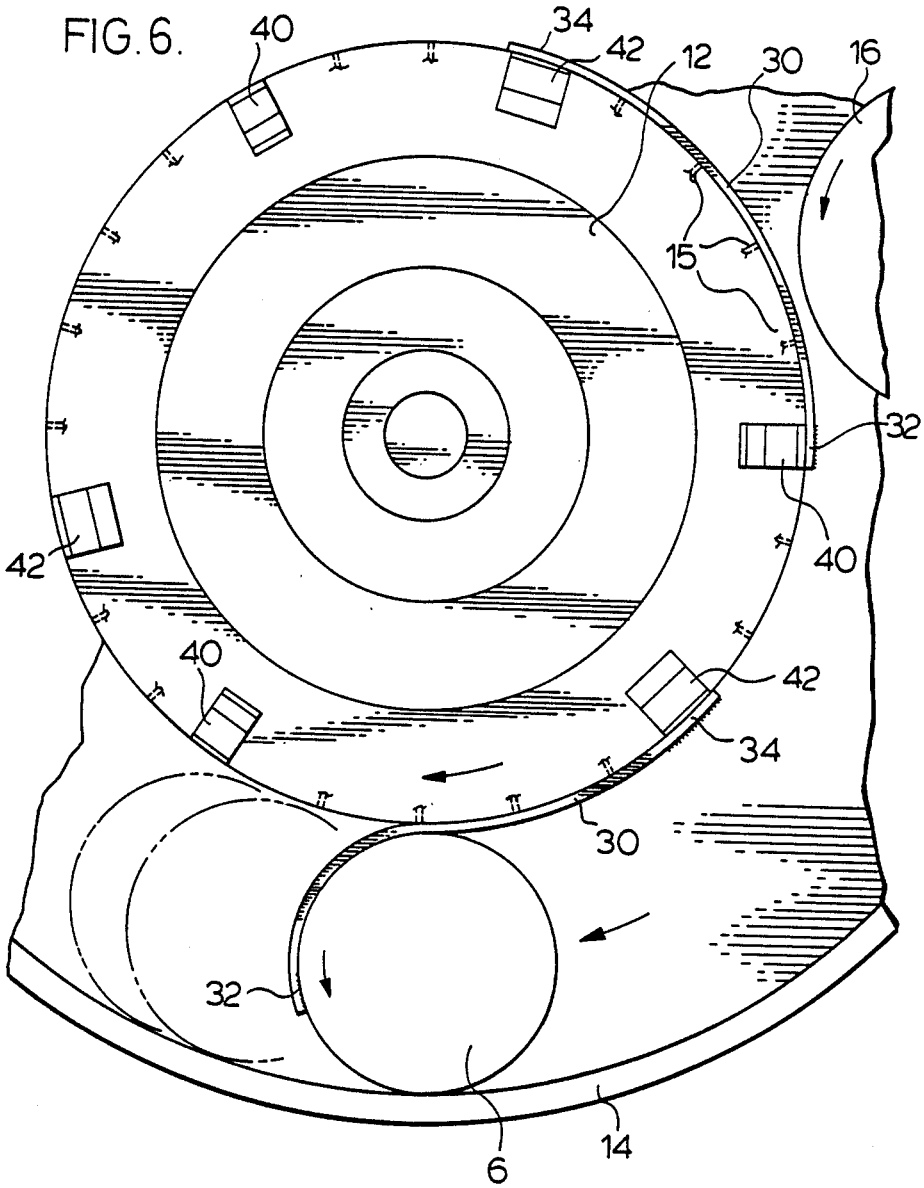
FIG. 6 is a top view showing a label being transferred to an article to be labelled as well as a further label on the vacuum drum.
Figure 7:
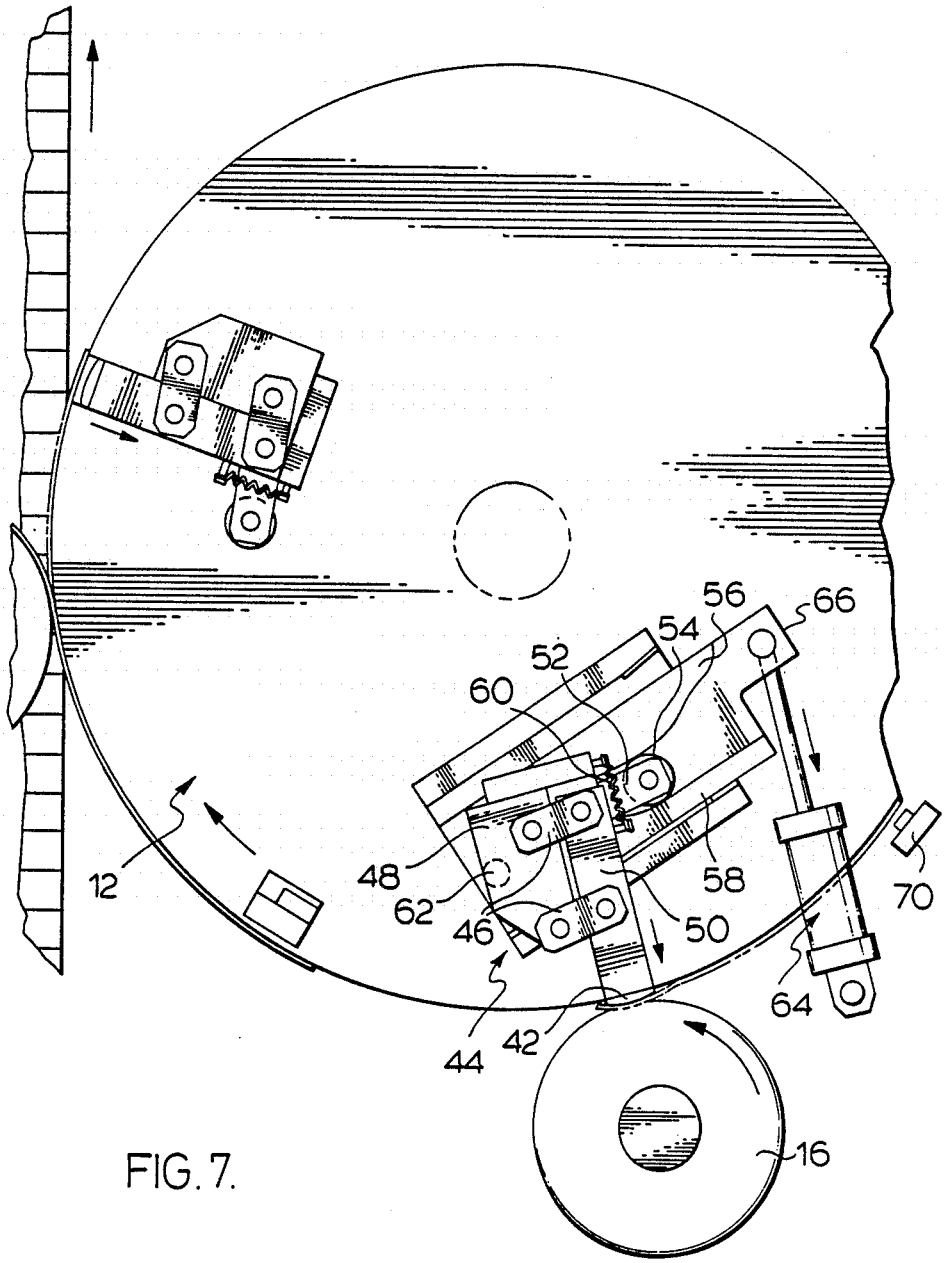
FIG. 7 is a top view showing the vacuum drum and the various pads to appropriately displace portions of the label for contact with the glue column.
Figure 8:
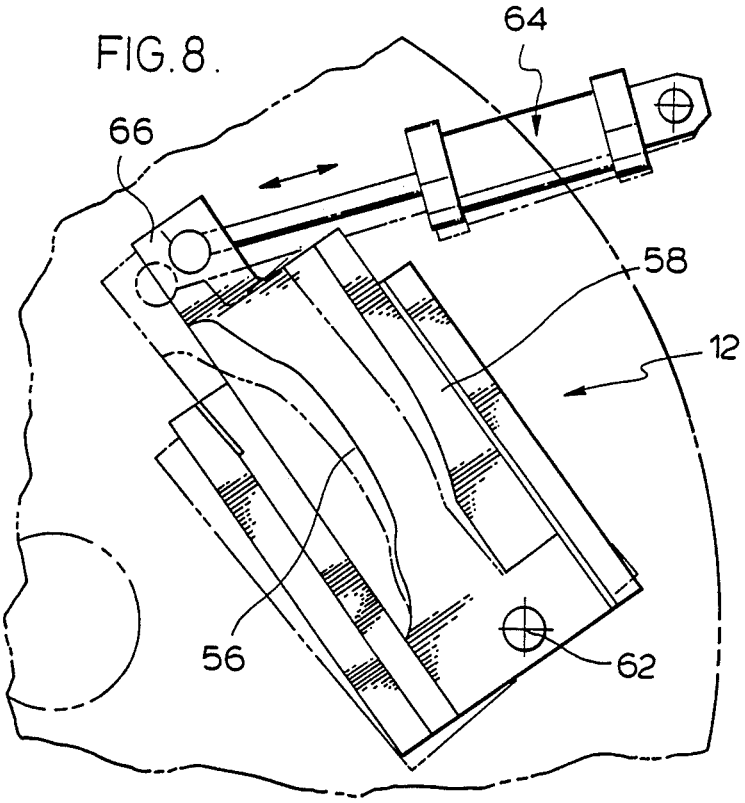
FIG. 8 illustrates a cam mechanism used to control the movement of the label pads.
Figure 9:
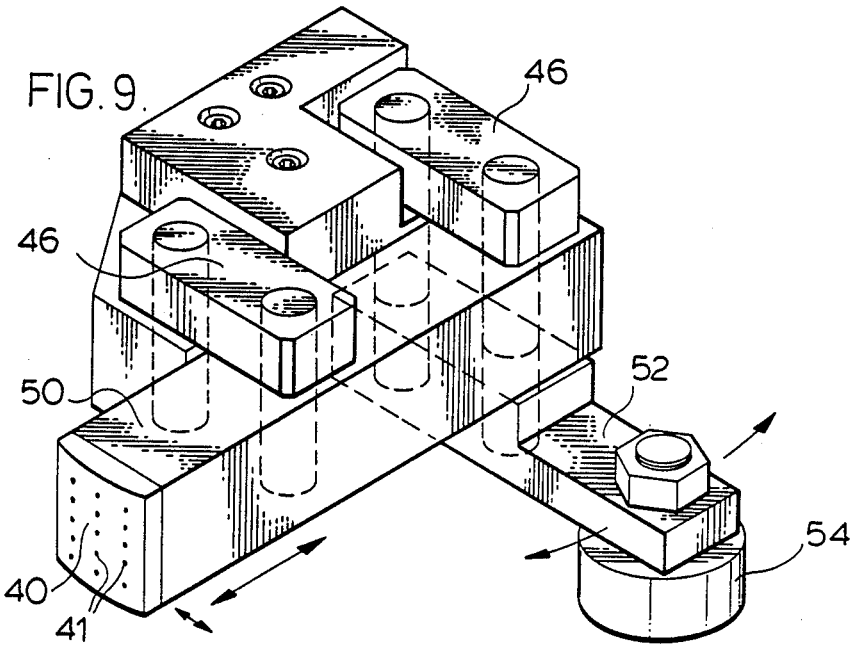
FIG. 9 shows an actuator assembly for moving the pads from a first position to a glue application position.

Further details of the vacuum drum 12 and the method in which the vacuum drum cooperates with the rail 14 is shown in FIG. 6. The vacuum drum 12 has a label 30 secured thereto and held against the vacuum drum by suction through the various ports generally shown as 15 which are found throughout the drum surface. The leading edge 32 of the label 30 overlies leading pad 40 with the trailing edge 34 of the label overlying the trailing pad 42. Glue has been applied to the leading edge 32 as pad 40 is forced outwardly, bringing the label into contact with the glue column. As the trailing portion 34 is advanced past the glue column 16, a cam member 56 will acutate the trailing pad 42 forcing the trailing portion 34 of the label into contact with the glue column 16. Upstream of the label that is being advanced past the glue column is a further set of pads and an associated label which is partially wrapped about an article 6 with the leading edge 32 in securement with the article and the trailing edge 34 still in contact with the trailing pad 42. The rail 14 ensures that the article 6 remains in contact with the vacuum drum a time sufficient to complete the wrapping of the label about the article.

With reference to FIG. 6, three sets of pads are positioned about the vacuum drum and are designed to accommodate one label between each set of pads. The pads are controlled to bring the leading or trailing edge of a label into contact with the glue column 16 as the label passes the glue column. The pads then return to their initial position which, in fact, preferably forms part of the cylindrical surface of the vacuum drum 12. In this way, the wrapping of the label about the article to be labelled is easier as the surface of the vacuum drum remains consistent. In some prior art machines, the leading and trailing edges of the label extend outwardly of the general periphery of the vacuum drum at all times and the glue column is moved out of contact with the surface if a label is not present. These prior art arrangements suffer in that the application of the label to the article is more troublesome as the surface of the vacuum drum is not cylindrical or consistent and further suffer in that the glue column, which is also driven to rotate about its longitudinal axis as indicated by the arrow, is a complex and heavy arrangement and the movement of this into and out of contact, depending upon whether a label is present or not, is cumbersome. The particular structure and method of urging the pads from an incoperative position, generally forming part of a cylindrical surface of the vacuum drum, to an operative position urging a portion of the label into contact with the glue column 16, can be appreciated from an understanding of FIGS. 7 through 9. Each of the leading or trailing pads is controlled by an actuating mechanism generally shown as 44 which includes pivoting link members 46 secured to the block support 48 which is generally fixed to the vacuum drum 12. Each pad is secured by a joining link 50 which is also connected to the pivoting links 46. These links define what can generally be considered a parallelogram type linkage which is positioned such that the leading pad is generally moved towards the middle area of the label when the actuating mechanism 44 is actuated whereby slippage of the label on the leading pad does not occur. This slight movement of the pad towards the center of the label is a result of the orientation of the linkage relative to the position of the label and assures that when the pad is again moved to its nonactive position where it defines part of the cylindrical surface of the vacuum drum, the label is flat against the vacuum drum in the same condition that it was initially applied to the vacuum drum. This movement of the leading vacuum pad can be seen by the arrows shown in FIG. 9 and FIG. 7. Buckling of the leading edge would cause problems as label application is commencing and there would be no probability of removing the buckle.

The linkage has secured thereto a lever actuator generally shown as 52 having a roller 54 at an end thereof. The roller 54 comes into contact with a generally stationary cam 56 which urges the linkage to move forcing the leading or trailing pad outwardly to the actuating position for application of adhesive to the leading or trailing edge of a label. The leading edge of the label does not slip on the vacuum pad 40 during displacement of the pad outwardly from the cylindrical surface of the vacuum drum, and similarly, the leading edge of the label on the pad does not shift on the pad when the actuating mechanism is returned to a position where the pad defines part of the cylindrical drum surface. Therefore, this linkage arrangement not only displaces a portion of the label, but displaces it in a manner that shifting of the label on the vacuum drum or pad need not occur. In addition, the vacuum drum has a cylindrical surface for application of a label to an article which surface can be deformed or displaced for selective application of adhesive to portions of labels.

A safety cam 58 is provided which serves two functions. Its first function is to assist in the return of the actuating mechanism to the inoperative position and is shaped to impart this necessary force. Furthermore, the safety cam in cooperation with sensor 70 and the actuating cylinder 64, cause the cam to move to an inoperative position such that the pads are not moved outwardly if sensor 70 does not sense a label on the vacuum drum. If for some reason a label was not in place on the vacuum drum, it would not be desirable to have the actuating pad forced outwardly as the surface thereof would be contaminated by adhesive. The sensor ensures that the pads are always covered by a label in that actuating cylinder 64 is activated and urges both the safety cam 58 and the actuating cam 56 to a position where the pads remain in the inoperative position when a label is not present. The cam and the control, therefore, only move to the operative position when a further label is sensed. In this way, the cam is controlled to be either in the operative or inoperative position and changes in these states only occur when a change in the label supply is determined by sensor 70. It should be noted that the linkage members are biased by a spring 60 to urge the actuating mechanism to the inoperative position. This spring alone could provide the return mechanism, however it cooperates with the actuating cam 56 and the safety cam 58 to take some play out of the mechanism and to maintain contact between roller 54 and cam 56 when the cam is itself in the operative position as determined by the sensor 70 and the actuating cylinder 64. The actuating cylinder 64 is pivotally secured at the free end 66 of the generally fixed cam 56, with this fixed cam being pivoted to the apparatus at point 62. Therefore, the cam pivots about point 62 as controlled by the actuating cylinder 64 to move between an operative position and an inoperative position.

Figure 10:
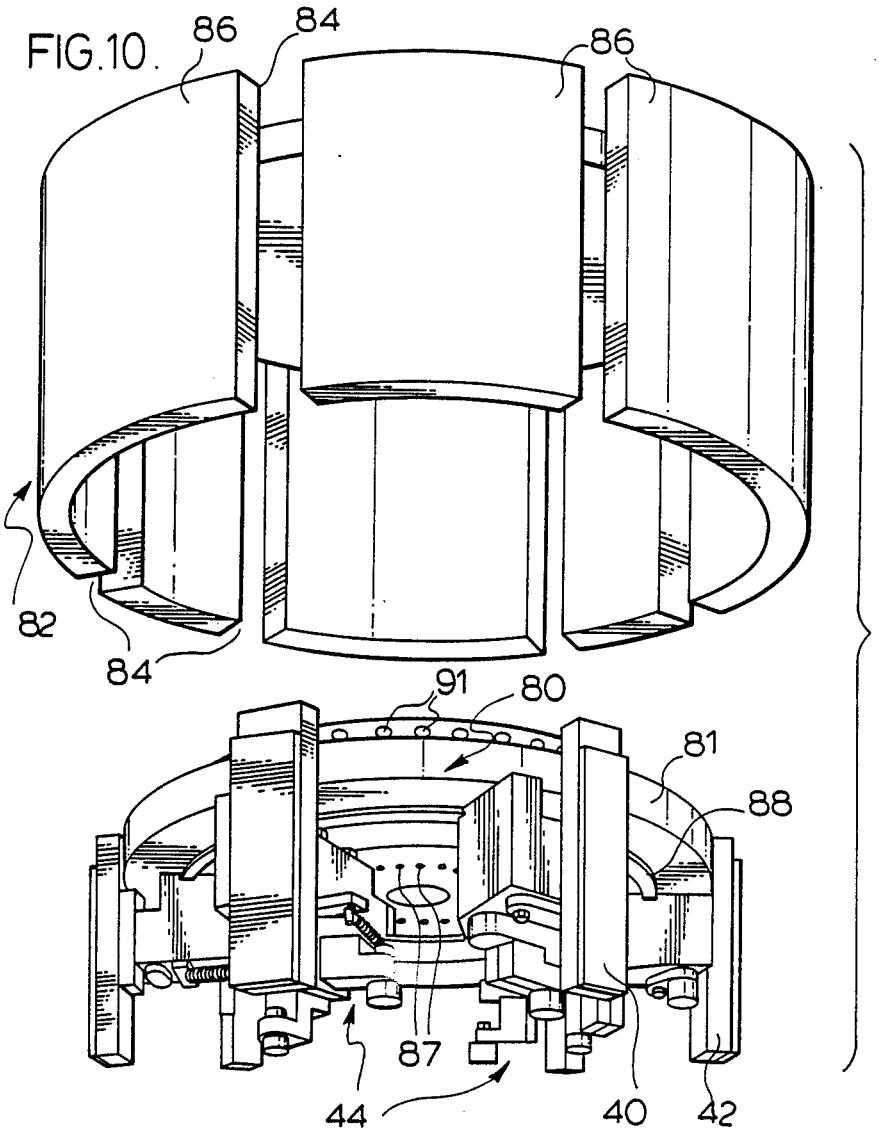
FIG. 10 is an exploded view of the vacuum drum.

The vacuum drum 12 as shown in FIG. 10 comprises an upper mounting rim 80 to which the actuating mechanisms 44 are secured, and a cooperating sleeve member 82 which has a number of slots 84 therein to accommodate the leading and trailing pads 40 and 42 as well as curved surfaces 86 which together with the pads collectively define the cylindrical surface of the vacuum drum 12. Surfaces 86 and the exterior surface of the pads 40 and 42 all include vacuum ports there throughout as is already known. The upper mounting rim has been drilled and various mounting holes for actuating mechanisms 44 are shown as 87 to allow selective placement of the leading pads and actuating mechanisms to accommodate labels of different lengths.

A separate sleeve 82 is shown in FIG. 10, however in some cases it may be preferable to separately install each curved surface 86 directly to face 81 shown in FIG. 10. Face 81 may be provided with threaded ports for attaching the pads, and means for connecting a vacuum port to each pad may be provided. Such an arrangement reduces the cost of the vacuum wheel 12.

Figure 11:
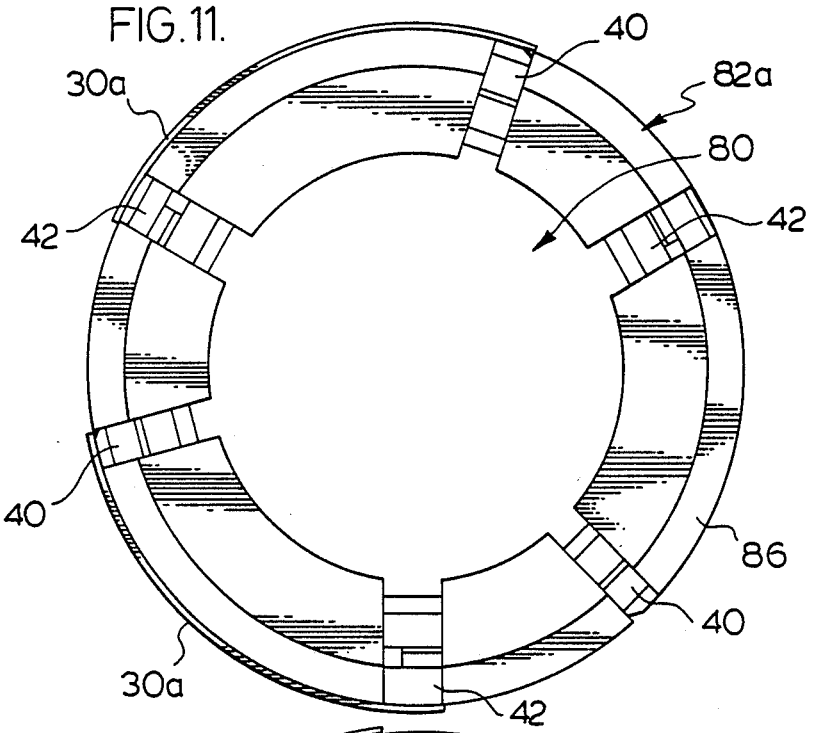
FIGS. 11 and 12 are top views of the vacuum drum adjusted for different label lengths.
Figure 12:
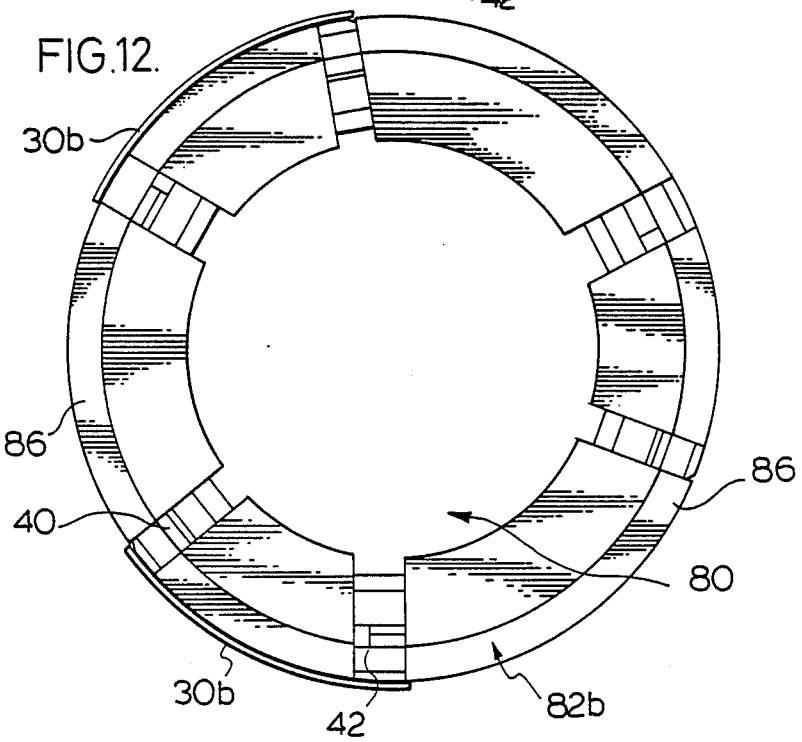

In order to facilitate positioning of the actuating mechanisms on the upper mounting rim, a circular ridge 88 is provided to reduce errors in the radial spacing of the mechanism from the center of the upper rim 80. To accommodate different label lengths, a different sleeve 82 will be provided where preferably the slots for the trailing pads are always in the same spot and the slots for the leading pads are placed for the approriate label length. In this way, a single upper mounting rim 80 can cooperate with a number of different sleeves 82 with the leading pads and associated actuating mechanisms adjusted in accordance with the label length as shown in FIGS. 11 and 12. This arrangement simplifies changeover of the labelling machine and reduces the cost associated with changeover as all actuating mechanisms are used regardless of the label length. In other arrangements, the entire vacuum drum requires changing and this increases the cost associated with hardware necessary for accommodating labels of different lengths. It is preferable that only leading pads move, thus reducing the amount of adjustment required.

A number of vacuum ports 91 are shown on the upper rim 80 and preferably are connected to the pads and sleeve 82 by flexible plastic lines. Such an arrangement simplifies changeover.

In FIGS. 11 and 12, two different vacuum drum configurations are shown where two separate sleeves **82*a* and 82*b* are shown. In each case, two labels are shown on each drum indentified as 30*a* and 30*b*, where 30*b* is considerably shorter in length. Changeover from one size to the other requires replacing sleeves, moving the leading pads and reconnecting various vacuum lines. No separate adjustment of the cam actuaters or pad actuators 44** is required.

Although various preferred embodiments of the present invention have been described herein in detail, it will be appreciated by those skilled in the art, that variations may be made thereto without departing from the spririt of the invention or the scope of the appended claims.

We claim:

1. In a labelling machine which applies individual labels to an article, a vacuum drum adapted to receive labels and transport the same to a desired location, said vacuum drum including a plurality of movable pads positioned for moving a leading or trailing end portion of a received label outwardly of the normal circumference of the drum a predetermined distance for adhesive application to a label, and means for controlling said pads to return the same to the initial position, and wherein said vacuum drum includes a central hub which adjustably receives leading and trailing edge pads for each label, said leading edge pads being adjustably received on said hub to vary the spacing between said leading and trailing edge pads in accordance with the length of labels to be applied, and a set of interchangeable surfaces which cooperate with said central hub to define the surface of said vacuum drum between said leading and trailing pads.

2. In a labelling machine as claimed in claim 1, wherein each pad is controlled by a linkage controlled to move the leading pad both radially of the drum and circumferentially in a direction toward the midpoint of an associated label.

3. In a labelling machine as claimed in claim 2, wherein said pads are controlled by a parallelogram linkage, said leading pads having the linkage orientated relative to the drum to maintain the position of the portion of a label on the pad as it is forced outwardly.

4. In a labelling machine as claimed in claim 2, including a glue roll in a fixed position relative to said vacuum drum and wherein said pads are controlled to move outwardly such that the end portion of a label thereon is brought into contact with said glue roll.

5. In a labelling machine as claimed in claim 4, including sensing means associated with said vacuum drum which determines whether a label is present on said pads and means associated with said sensing means and said pads to cause movement of said pads in the radial direction only when a label is present.

6. In a labelling machine as claimed in claim 5, including a movable cam means cooperating with said pads to effect movement thereof, said cam means being movable between an operative position and an inoperative position in accordance with said sensing means, said cam means in the operative position urging said pads outwardly and in the inoperative position allowing said pads to remain in the initial position.

7. In a labelling machine as claimed in claim 6, wherein said cam means is controlled by an actuating cylinder to effect movement between the operative and inoperative positions.

8. In a labeller as claimed in claim 1, wherein said set of interchangeable surfaces is a set of interchangable sleeves appropriately slotted to provide open areas to accommodate said pads with each sleeve being for use with a given label length.

9. In a labelling machine as claimed in claim 1, wherein said set of interchangeable surfaces is a set of interchangeable pads securable to the drum.

* * * * *